US008628305B2

(12) United States Patent
Leu et al.

(10) Patent No.: US 8,628,305 B2
(45) Date of Patent: Jan. 14, 2014

(54) FLUID INTAKE AND EXHAUST FITTINGS FOR A COMPRESSOR OR PUMP

(75) Inventors: Shawn Alan Leu, Newton, WI (US); Stephen Mark-Allen Moretti, Manitowoc, WI (US)

(73) Assignee: Gardner Denver Thomas, Inc., Sheboygan, WI (US)

( * ) Notice: Subject to any disclaimer, the term of this patent is extended or adjusted under 35 U.S.C. 154(b) by 444 days.

(21) Appl. No.: 12/376,908

(22) PCT Filed: Sep. 5, 2007

(86) PCT No.: PCT/US2007/077582

§ 371 (c)(1),
(2), (4) Date: Feb. 27, 2009

(87) PCT Pub. No.: WO2008/030839

PCT Pub. Date: Mar. 13, 2008

(65) Prior Publication Data

US 2010/0178185 A1 Jul. 15, 2010

Related U.S. Application Data

(60) Provisional application No. 60/824,481, filed on Sep. 5, 2006.

(51) Int. Cl.
*F16L 25/00* (2006.01)
*F04B 17/00* (2006.01)

(52) U.S. Cl.
USPC ..... 417/410.1; 417/531; 417/533; 417/902

(58) Field of Classification Search
USPC ..... 417/410.1, 410.3, 531, 533, 539, 312, 417/902, 572
See application file for complete search history.

(56) References Cited

U.S. PATENT DOCUMENTS 2,134,077 A 10/1938 Ehret
3,207,083 A 9/1965 Lohry et al.
(Continued)

FOREIGN PATENT DOCUMENTS

EP 0 151 519 8/1985
EP 0 764 808 3/1997
(Continued)

OTHER PUBLICATIONS

PCT/US07/77582 PCT Written Opinion of the International Search Authority dated Apr. 3, 2008 (5 pages).

(Continued)

*Primary Examiner* — Karabi Guharay
(74) *Attorney, Agent, or Firm* — James B. Conte; Husch Blackwell LLP

(57) ABSTRACT

A compressor or vacuum pump fluid intake manifold has fluid intake and a pair of ports provided by male and female fittings that are slidably engaged to one another. The male fitting has a portion which forms a hollow plug which fits within a respective fluid intake of the compressor housing. The plug portion, or plug, is integrally molded with a longitudinal section of the male fitting member. In similar fashion, the female fitting includes a plug portion which interfaces with a fluid intake in the compressor housing. The plug portion is integrally molded with a longitudinal portion of the female fitting. In one embodiment, each of the plugs includes three extending flanges forming an integral portion of the plug. Two of the three flanges provide a contact pressure seal with portions of the compressor housing that define the fluid intakes which receive the plugs. The other flange serves to prevent the plugs from slipping out of the fluid intakes during normal use of the fluid intake manifold. Further, instead, each of the plugs can have a raised insert surface defining a groove with an O-ring and a flange integral with and extending from a surface of the plug.

4 Claims, 13 Drawing Sheets

(56) References Cited

U.S. PATENT DOCUMENTS

| | | | | |
|---|---|---|---|---|
| 3,273,717 | A | 9/1966 | Canterbury | |
| 3,495,540 | A | 2/1970 | Edwards | |
| 4,388,050 | A | 6/1983 | Schuller | |
| 4,764,097 | A | 8/1988 | Hirahara et al. | |
| 4,824,335 | A | 4/1989 | Lubitz et al. | |
| 4,889,475 | A | 12/1989 | Gannaway et al. | |
| 4,936,753 | A | 6/1990 | Kozumplik, Jr. et al. | |
| 5,022,146 | A | 6/1991 | Gannaway et al. | |
| 5,290,152 | A | 3/1994 | Wallace et al. | |
| 5,354,185 | A | 10/1994 | Morinigo et al. | |
| 5,630,708 | A | 5/1997 | Kushida et al. | |
| 5,644,969 | A | 7/1997 | Leu et al. | |
| 5,685,458 | A | 11/1997 | Durham et al. | |
| 5,934,070 | A * | 8/1999 | Lagelstorfer | 60/280 |
| 6,126,410 | A | 10/2000 | Kung et al. | |
| 6,331,101 | B2 | 12/2001 | Leu et al. | |
| 6,412,474 | B1 | 7/2002 | Guentert et al. | |
| 6,497,836 | B2 | 12/2002 | Krause et al. | |
| 6,692,240 | B1 | 2/2004 | Leonhard | |
| 6,767,001 | B2 | 7/2004 | Anderson | |
| 6,776,589 | B2 | 8/2004 | Tomell et al. | |
| 6,782,878 | B2 | 8/2004 | Spix | |
| 7,204,272 | B2 | 4/2007 | Steinberg | |
| 2002/0041096 | A1 | 4/2002 | Krause | |
| 2003/0219346 | A1 | 11/2003 | Abe et al. | |
| 2004/0144373 | A1 | 7/2004 | Spix | |

FOREIGN PATENT DOCUMENTS

| | | |
|---|---|---|
| GB | 585898 | 2/1947 |
| GB | 1 415 024 | 11/1975 |
| JP | 61126395 | 6/1986 |
| JP | 06-257671 | 9/1994 |
| JP | 09-042454 | 2/1997 |
| JP | 10-252647 | 9/1998 |
| JP | 2000-320458 | 11/2000 |
| JP | 2003-009459 | 1/2003 |
| JP | T 2003-515161 | 4/2003 |
| JP | 2005-054868 | 3/2005 |
| WO | WO 01/38743 | 5/2001 |

OTHER PUBLICATIONS

International Search Report PCT/US07/77582 dated Apr. 3, 2008 (3 pages).

PCT/US2007/077582 PCT International Preliminary Report on Patentability dated Mar. 10, 2009 (4 pages).

Search Report for companion UK case GB 1000154.3 (1 page).

Examination Report for companion GB 1000154.3 (2 pages).

Search Report GB0609668.9 dated Dec. 22, 2006 (1 page).

Microfilm of Japanese Utility Model Registration Application No. 53-105028 (Japanese Utility Model Laid-Open No. 55-022540).

Japanese Office Action related to companion case 2006-138180.

Office Action, mailed Jul. 28, 2011, regarding U.S. Appl. No. 12/345,065 (in particular see pp. 3-4).

Japanese Office Action dated Nov. 8, 2011 for companion case JP 2009-527530.

Office Action for related case U.S. Appl. No. 11/383,315, filed May 15, 2006, parent of related case U.S. Appl. No. 12/345,065.

Copy of Filing Receipt for related case U.S. Appl. No. 11/383,315, filed May 15, 2006 claiming the benefit of U.S. Appl. No. 60/681,814, filed May 17, 2005.

Patent application for related case U.S. Appl. No. 11/383,315, filed May 15, 2006 claiming benefit of U.S. Appl. No. 60/681,814 (see claims 24-30).

Patent application for related U.S. Appl. No. 60/681,814, filed May 17, 2005 (see claims 23-28).

Preliminary Amendment filed in related case U.S. Appl. No. 12/345,065 (see claims 7-10, 19).

A schematic of a cap plug which applicant acknowledges is prior art (2 pages).

Final Office Action dated Mar. 9, 2012 for corresponding U.S. Appl. 12/345,065.

Translation of Oct. 2, 2012 Office Action for Japanese companion case JP 2009-527530.

Machine language translation for Mar. 3, 2005 Japanese publication 2005-054868.

* cited by examiner

FLUID INTAKE AND EXHAUST FITTINGS FOR A COMPRESSOR OR PUMP

The present application is a 371 of international application PCT/US2007/077582, filed 5 Sep. 2007 which claims the benefit of U.S. provisional application 60/824,481, filed 5 Sep. 2006.

FIELD OF INVENTION

The present invention concerns fluid intake and exhaust fittings for compressors or pumps.

BACKGROUND

It is known in the art to utilize a fluid intake manifold assembly that has at least two ports which interface and couple to each of two compressor housing intake ports in a dual piston compressor. An example of such a manifold can be seen in FIGS. 1 and 2. The manifold in FIG. 1 consists of two ports 32*a* and 32*b* which couple to the compressor, two plastic tubular members 30*a* and 30*b* and intake port 33. As can be seen, the ports 32*a*, 32*b* are formed from plastic elbows. One end 32*a'*, 32*b'* of each elbow extends into the corresponding housing inlet. Each elbow 32*a*, 32*b* is threaded and screws into its respective inlet. The other end of each elbow, 32*a*" and 32*b*" is attached to respective ends 30*a'*, 30*b'* of a tubular member 30*a*, 30*b*. The intake port 33, is a plastic T-shaped hollow fitting, and joins the open ends 30*a*", 30*b*" of each tubular member 30*a*, 30*b*. The arrows 35 show the manner in which the air flows into the housing of the dual piston air compressor 40.

FIG. 2 discloses an alternative fluid intake assembly. The assembly has a single elbow 32*a* and a single T member 34. The elbow 32*a* and T member 34 are joined by a tubular member 36. The T member 34 and elbow are threaded and screw into their respective inlets. Air is drawn into the dual piston compressor along arrows 37.

SUMMARY

The present inventors have found that it is desirous to provide a fluid intake manifold assembly with fewer components than the standard assembly. The inventors have also found that it is desirous to provide a fluid intake manifold which reduces the amount of assemblage required to interface a dual piston pump or compressor with a fluid intake manifold.

The present inventors have also found that it is desirous to provide a port fitting that interfaces with inlets and outlets in a compressor or pump in a manner easier than fittings having threads but reliably as fittings having threads.

The present invention reduces some of the required assemblage by providing a fluid intake manifold that includes a female fitting and a male fitting slidably engaged to one another to provide a fluid intake and two ports.

The male fitting member includes a first port which interfaces with a fluid intake in the compressor housing. The male fitting's first port is also in fluid communication with the fluid intake of the fluid intake manifold. The first port is defined by a portion of the male fitting which forms a hollow plug which fits within a respective fluid intake of the compressor housing. The plug portion, or plug, is integrally molded with a longitudinal section of the male fitting member. The male fitting defines a fluid pathway.

The fluid intake manifold further includes a female fitting which defines a fluid intake pathway. In similar fashion to the male fitting, the female fitting includes a plug portion which interfaces with a fluid intake in the compressor housing. The plug portion is integrally molded with a longitudinal portion of the female fitting. The plug defines a second port which is in fluid communication with a respective fluid intake of the intake manifold. The female fitting has a female coupling portion which receives the male coupling portion on the male fitting. The male and female fittings, when assembled, provide a longitudinal fluid pathway which extends between each of the ports defined by the plugs. The pathway thus places each of the ports in fluid communication with one another and with a fluid intake of the manifold.

In one embodiment of the invention, the plug on the female member and the male member includes three extending flanges forming an integral portion of the plug. Two of the three flanges are furtherest away from the plug. These two flanges provide a contact pressure seal with portions of the compressor housing that define the fluid intakes which receive the plugs. The other one of the three flanges does not function to serve as a contact seal. It rather serves to prevent the plugs from slipping out of the fluid intakes during normal use of the fluid intake manifold. This one flange, when its respective plug is fully inserted in the intake, extends over a ledge portion of the compressor housing. The ledge acts as a backstop over which the flange, which acts as an abutment, must be pulled to remove the plug from its respective intake.

In another embodiment of the invention, the plugs of the male and female fitting include a raised insert surface defining a groove. An o-ring is disposed in the groove. The plug also has a flange integral with and extending from a surface of the plug. The o-ring provides a contact pressure seal with portions of the housing defining the compressor intake. The radially extending flange serves to inhibit the removal of the plug from the compressor intakes during normal use of the fluid manifold. The flange acts as an abutment against portions of the compressor housing forming a ledge or backstop.

In still a further embodiment of the invention, port fittings which have generally known shapes such as elbow or T fittings, include a plug portion for interface with a compressor or pump fluid intake. The plug portion has the three flanges described above or the plug configuration having the o-ring in combination with a flange. Notably, a port fitting construction having its plug portion configured to have the o-ring and flange combination will serve as a port fitting for a compressor or pump outlet.

BRIEF DESCRIPTION OF THE DRAWINGS

The drawings are provided to illustrate embodiments of the invention. It is envisioned that alternate configurations of the embodiments of the present invention may be adapted and be within the scope of the disclosed invention as illustrated in these drawings.

DETAILED DESCRIPTION

Figure 1:
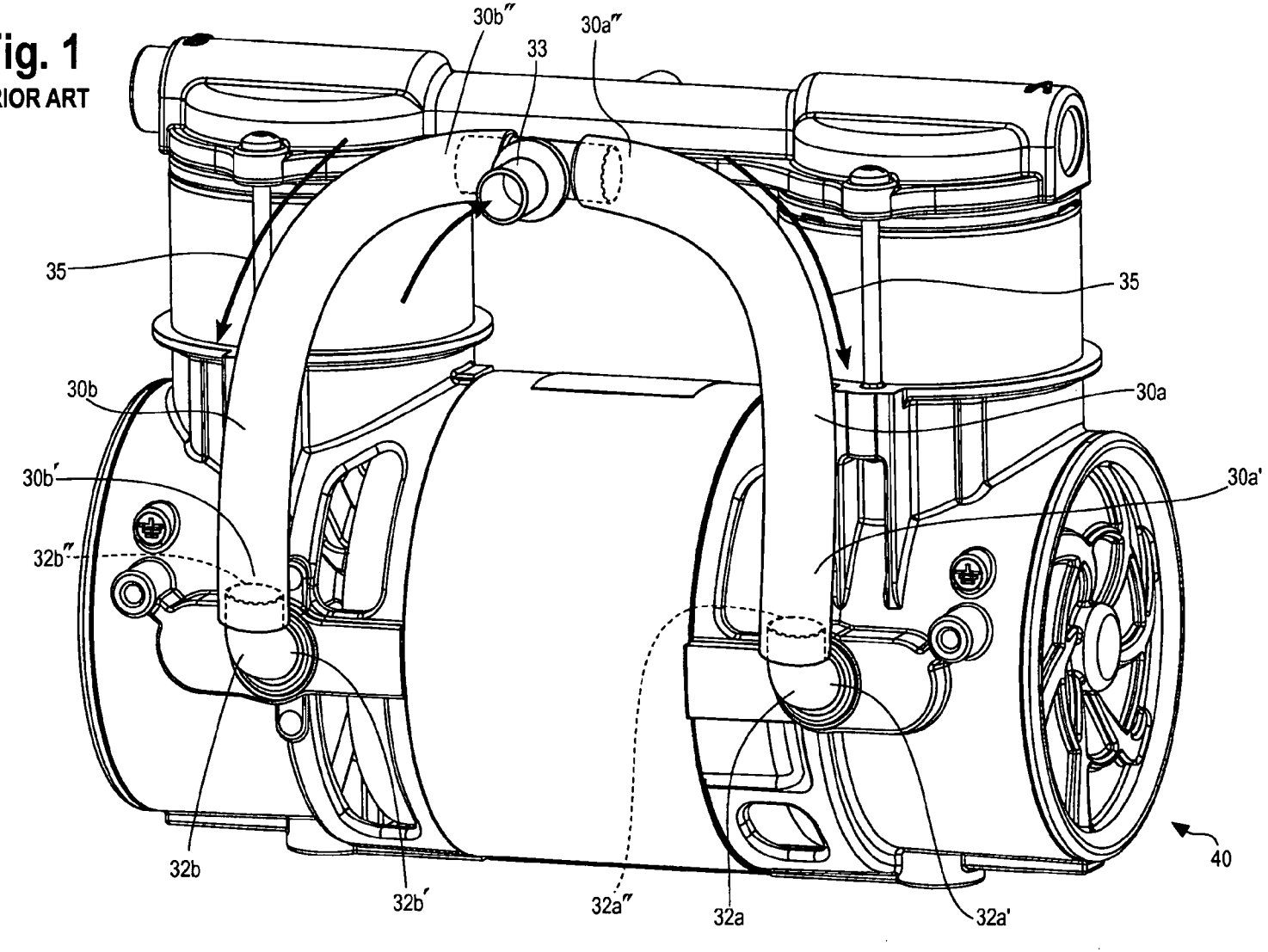
Fig. 1 PRIOR ART
FIG. 1 is a front prospective view of an air compressor showing a standard air intake manifold assembled to the compressor.
Figure 2:
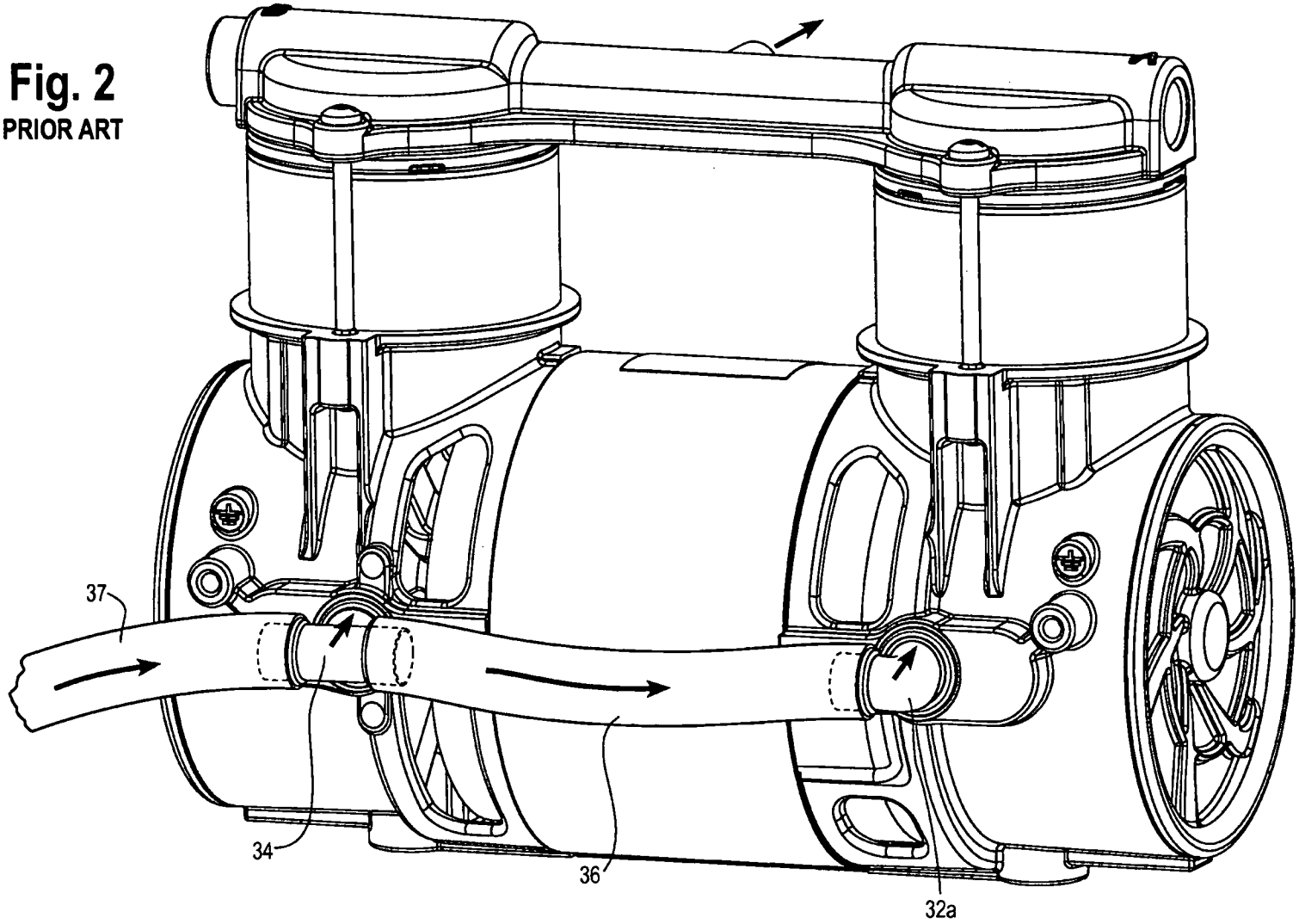
Fig. 2 PRIOR ART
FIG. 2 is a front prospective view of the air compressor shown in FIG. 1 showing an alternative standard air intake manifold assembled to the compressor.

The various parts and components of the invention can be seen and understood with reference to the drawings and description herein. Referring now to FIGS. 3*a*, 3*b* and 4*a*-4*f*, details of the male fitting or first member 101 which forms a component of the fluid intake manifold or assembly can be seen and understood. Male fitting member 101 includes the fluid coupling 100 and male coupling 102 longitudinally spaced from the fluid coupling 100. The male coupling 102, is sized to be received by a female coupling 202 on the female fitting member 201. The male fitting further includes a longitudinal section 104 joining the male coupling 102 and fluid coupling 100. The male fitting further includes a port 106. The port 106 extends outward from longitudinal section 104. The port 106 is a plug.

The fluid coupling 100 has an opening 100*a* therein. The opening 100*a* opens through an external end 100*b* of the fluid coupling 100. The fluid coupling 100 opens at fluid passage 104*a* of the longitudinal section 104. The opening can be seen at 100*c*. The fluid coupling 100 is a fluid intake coupling.

Male coupling 102 also has an opening 102*a* which opens through an external surface or end 102*b* of male coupling 102. The male coupling opens at longitudinal passage 104*a*. The opening can be seen at 102*c*.

The plug portion 106 has an internal orifice 106*d*. The plug has an external opening 106*a* opening at orifice 106*d*. Longitudinal section 104 has an opening or aperture 104*b* which opens at plug orifice 106*d*. The plug orifice is thus in fluid communication with the passage 104*a*. The plug 106 on its external surface has two annular grooves 106*b* formed therein. The annular grooves receive and support o-rings 107, 107'.

As can be appreciated from the drawings, the male fitting member 101 having portions 100, 102, 104 and 106 is a single unitary member, preferably made of plastic. Thus, the plug 106, the fluid coupling 100, and the male coupling 102 are integral with longitudinal section 104.

As can further be seen, the male fitting on its external surface towards the male coupling 102 has a groove 102*d* which receives an o-ring.

The female fitting or second member 201 can be seen and understood with reference to FIGS. 3*a*, 3*b* and 5*a*-5*f*. The female fitting member has a fluid coupling 200 and a female coupling 202 longitudinally spaced from the fluid coupling 200. The fluid coupling 200 is a fluid intake coupling. The female coupling 202, is sized to receive male coupling 102 on the male fitting member. The female fitting further includes a longitudinal section 204 joining the female coupling 202 and fluid coupling 200. The female fitting further includes a port 206. The port 206 extends outward from longitudinal section 204. The port 206 is a plug.

The fluid coupling 200 has an opening 200*a* therein. The opening 200*a* opens through an external end 200*b* of the fluid coupling 200. The fluid coupling 200 opens at a fluid passage 204*a* of the longitudinal section 204. The opening can be seen at 200*c*.

Female coupling 202 also has an opening 202*a* which opens through an external surface 202*b* of female coupling 202. The female coupling opens at longitudinal passage 204*a*. The opening can be seen at 202*c*.

The plug portion 206 has an internal orifice 206*d*. The plug has an external opening 206*a* opening at orifice 206*d*. Longitudinal section 204 has an opening or aperture 204*b* which opens at orifice 206*d*. Thus fluid passage 204*a* and orifice 206*d* are in fluid communication. The plug 206, on its external surface, has two annular grooves 206*b* formed therein. The annular grooves receive and support o-rings 207, 207'. The female fitting consists of a single unitary member, preferably made of plastic. Thus, the plug 206, the fluid coupling 200 and the female coupling 202 are integral with longitudinal section 204.

Figure 6:
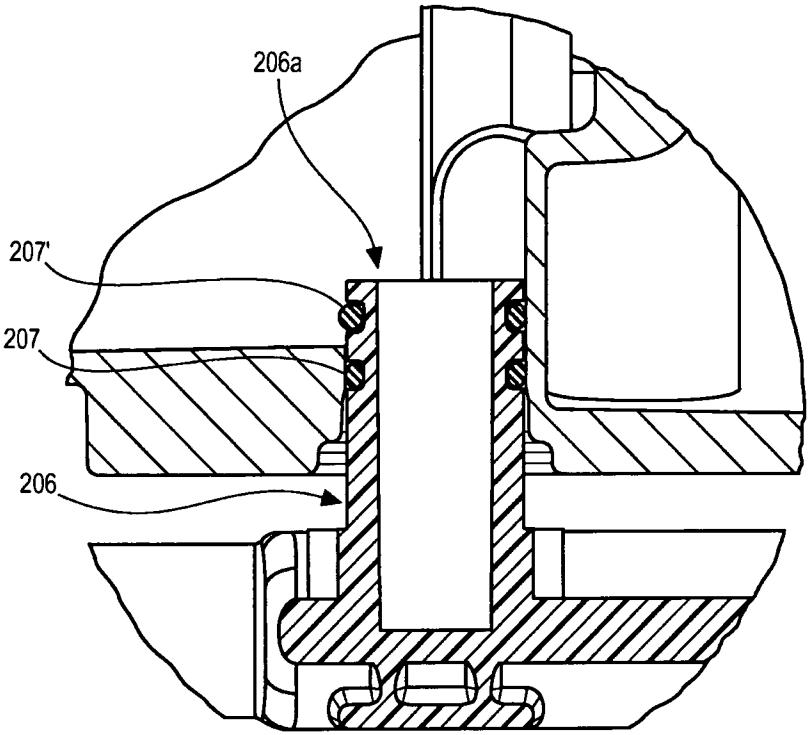
FIG. 6 is a cross-sectional view showing a plug portion of the air intake manifold shown in FIG. 3*b*.

As can further be seen, female fitting 201 has a reduced transverse length starting at 202*d* of the female coupling. Reducing the transverse length of the female fitting saves on material. The constriction at 202*d* could also act as an abutment to prevent the male coupling from extending to far into the female fitting As can be seen in FIG. 6 when plug 206 is fully inserted into housing intake 44 (FIG. 3B), the o-ring 207 axially furthest from plug open end 206*a* provides a contact seal with the housing portion 44*a* (FIG. 7) defining housing intake 44. The o-ring 207' nearest plug opening 206*a* does not function to provide a contact seal with the housing portion defining the housing intake. This o-ring 207' functions to prevent the plug portion from slipping out of the intake housing 44 during normal use. The o-ring 207' in FIG. 6 extends into pump housing intake 44 so it is internal of housing ledge 44*b*. See FIGS. 7 and 9 for Ledge 44*b*. Ledge 44*b* thus provides a backstop over which o-ring 207', which is acting as an abutment, must be pulled to remove plug portion 206 from housing intake 44. Plug portion 106 and housing intake 45 interface in the same way as plug portion 206 and housing intake 44.

As can best be seen by reference to FIGS. 4*a*, 4*e*, 5*a*, 5*e*, the longitudinal sections 104, and 204, female coupling 202, and male coupling 102 all have oval cross-sections. The oval cross-section's long axis runs in the direction of arrow 300. The oval cross section allows for the manifold to present a slim profile along the pump housing's transverse axis.

As can be seen in FIGS. 4*a*, 4*e* and FIGS. 5*a*, 5*e* the plugs 106, 206 each have stops 106*e* and 206*e*. The stops help ensure that the plugs are properly oriented with respect to the housing air intakes 44, 45. The stops provide abutments and help prevent over insertion of the plug portions.

Figure 3A:
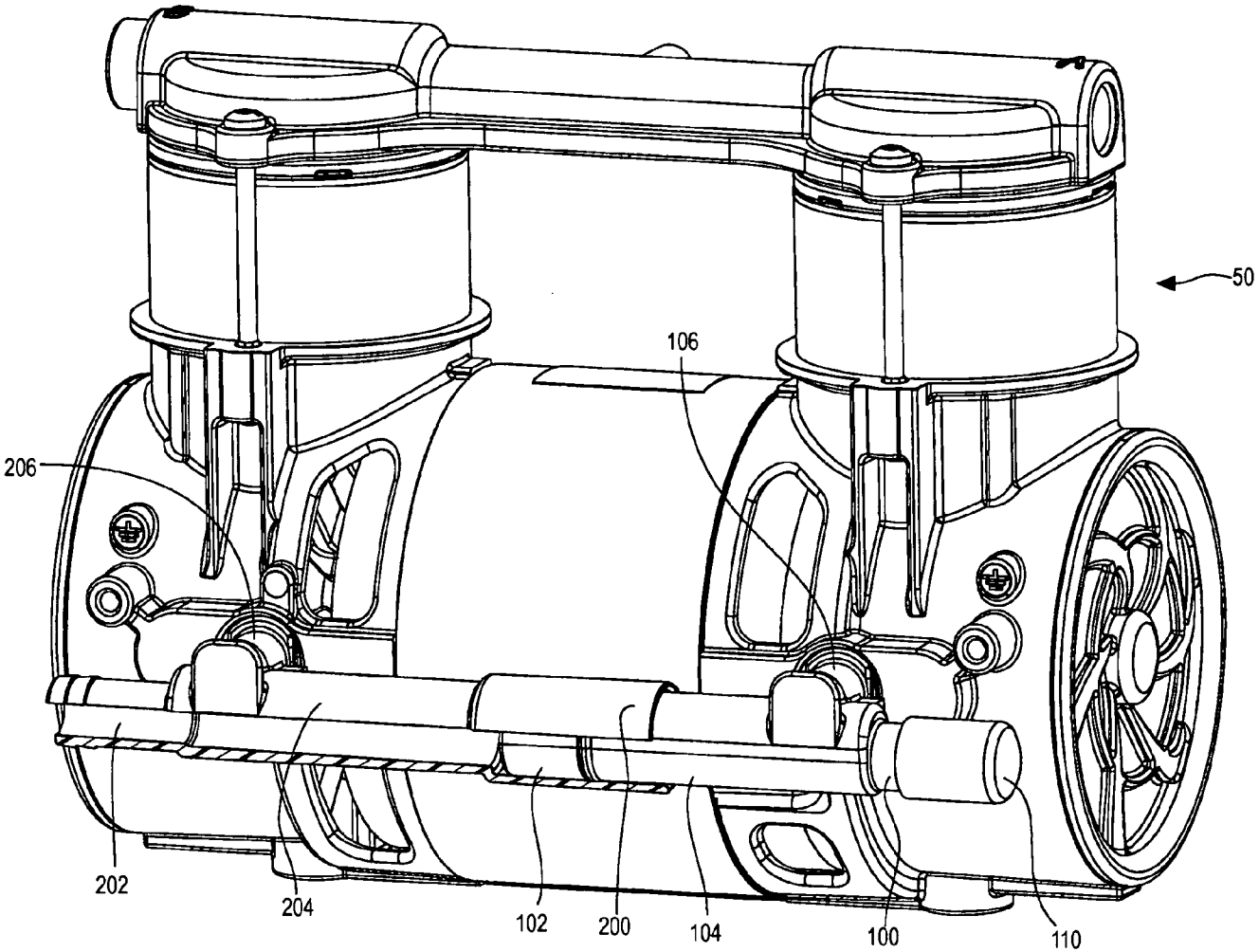
FIG. 3*a* is a front prospective view of an air compressor showing an air intake manifold assembled to the compressor, said air intake manifold embodying an example of the invention.
Figure 3B:
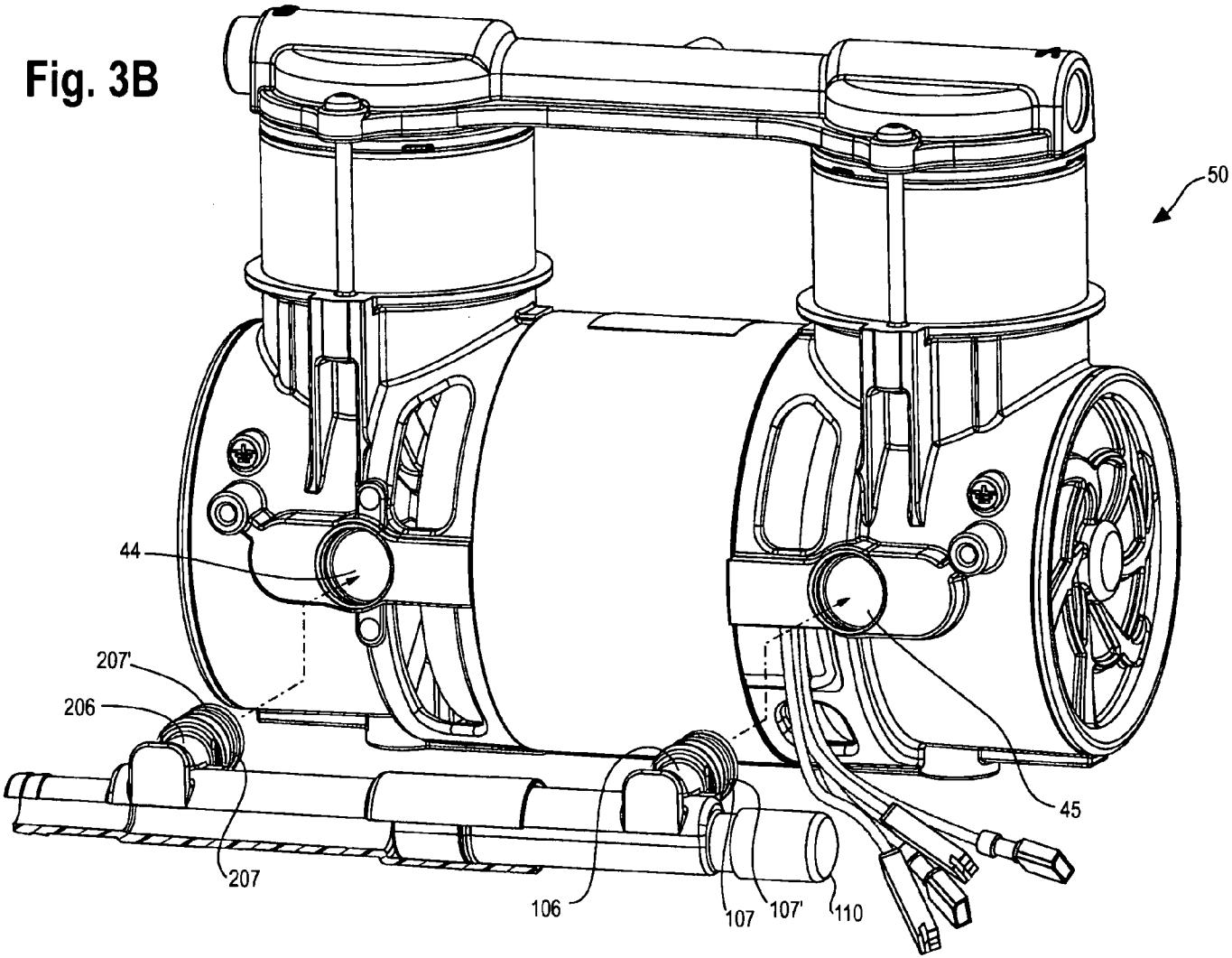
FIG. 3*b* is a front perspective view of the compressor and air intake manifold shown in FIG. 3*a* with the air intake manifold disassembled from the compressor.
Figure 4A:
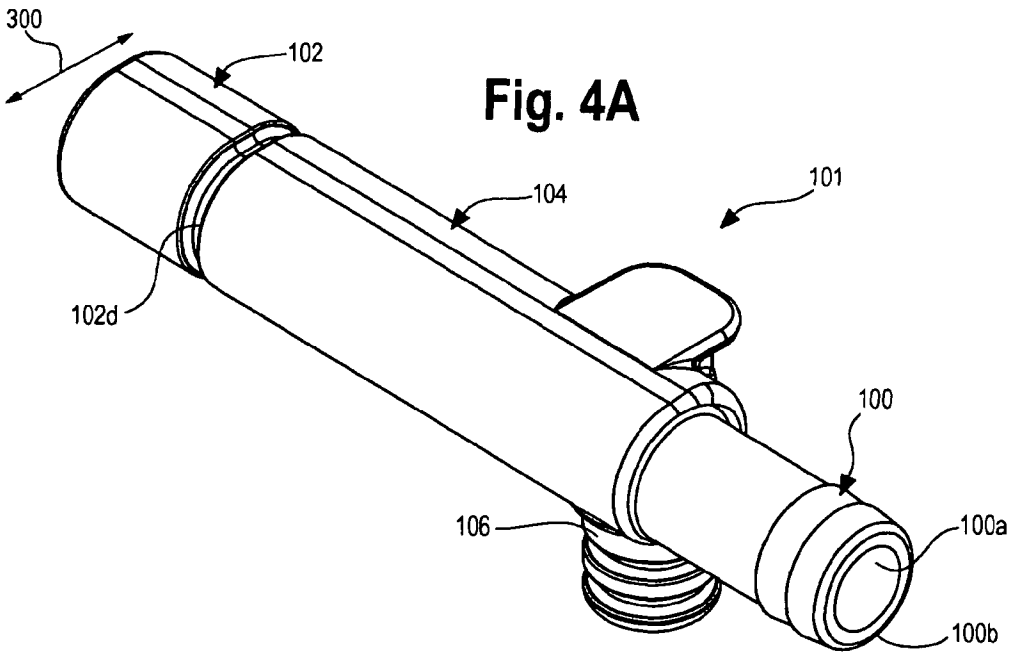
FIG. 4*a* is a perspective view of the male fitting member which forms a component of the air intake manifold shown in FIG. 3*b*; the perspective looks down at a front side of the male member.
Figure 4B:
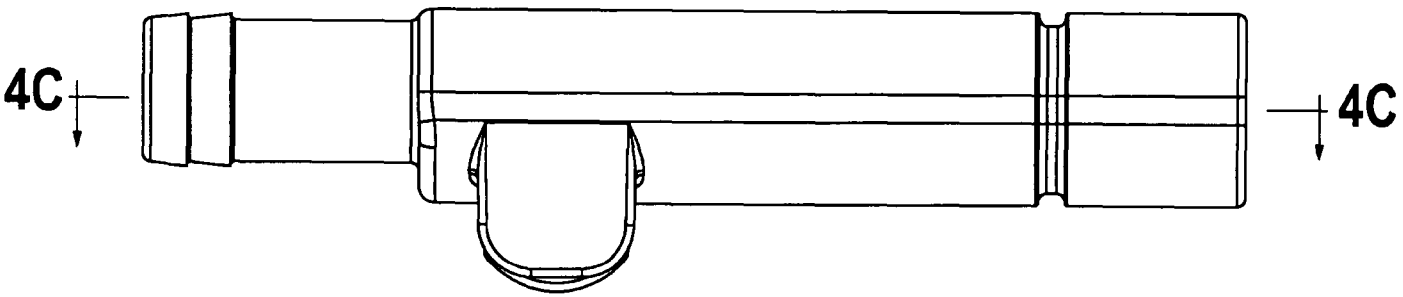
FIG. 4*b* is a plan view looking at the front side of the male member shown in FIG. 4*a;*
Figure 4C:
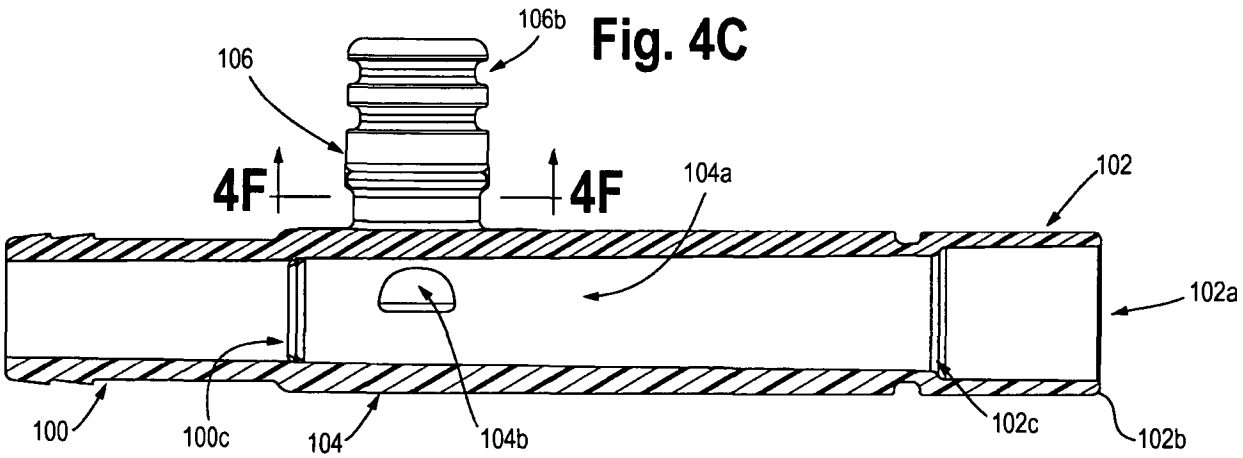
FIG. 4*c* is a sectional view of the male member shown in FIG. 4*a* taken along view lines C-C of FIG. 4*b*; the male member has been rotated to face the plug portion of the male member towards the top of the page.
Figure 4D:
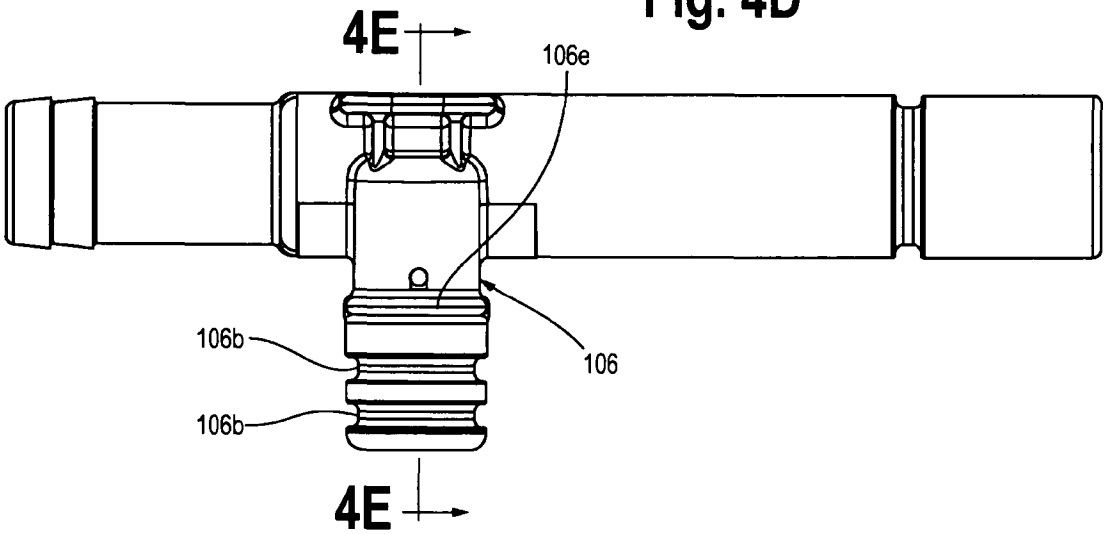
FIG. 4*d* is a rear sided plan view of the male member shown in FIG. 4*a;*
Figure 4F:
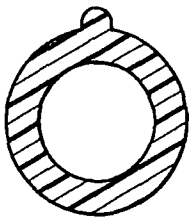
FIG. 4*f* is a sectional view taken along view lines F-F of the male member shown in FIG. 4*c;*
Figure 4E:
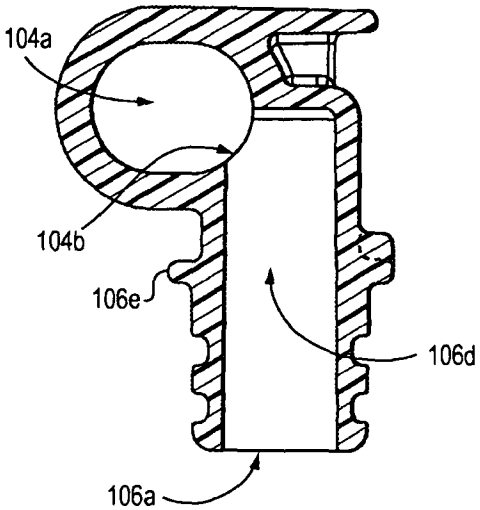
FIG. 4*e* is a sectional view taken along view lines E-E of the male member shown in FIG. 4*d;*
Figure 5A:
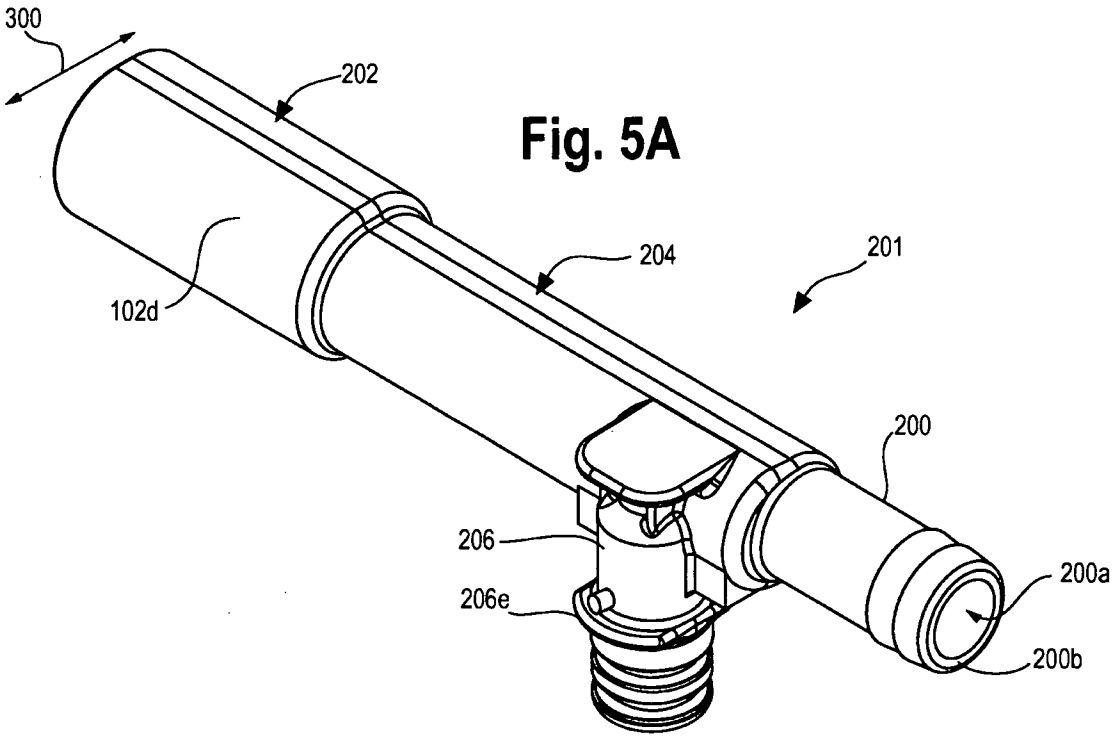
FIG. 5*a* is a perspective view of the female fitting member which forms a component of the air intake manifold shown in FIG. 3*b*; the perspective looks at a front side of the female member.
Figure 5B:
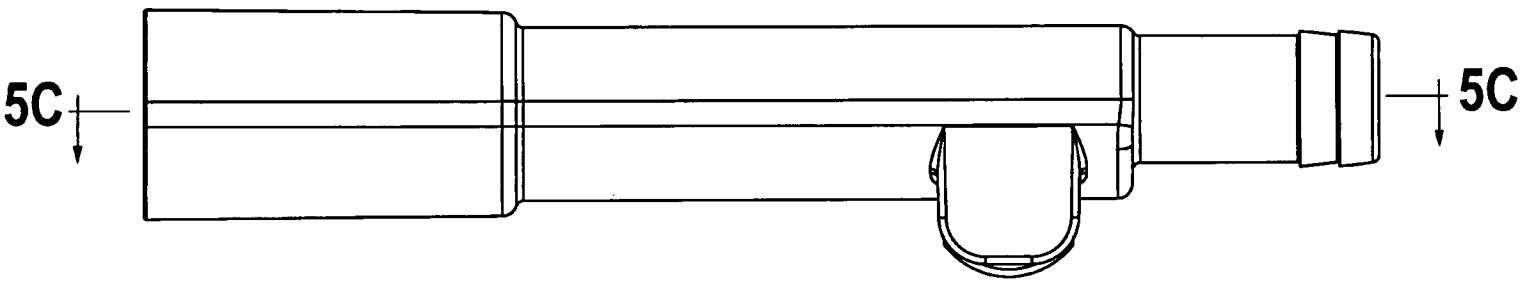
FIG. 5*b* is a plan view looking at the front side of the female member shown in FIG. 5*a;*
Figure 5C:
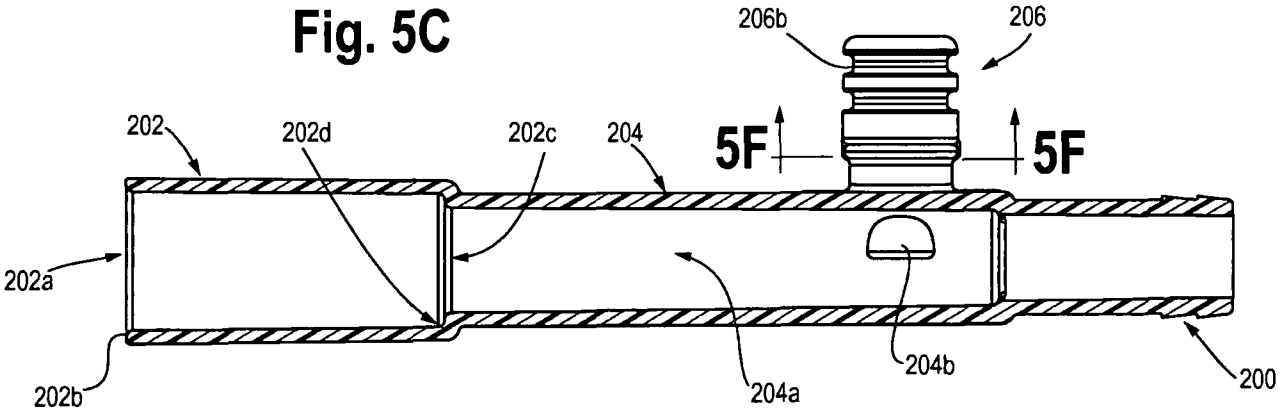
FIG. 5*c* is a sectional view of the female member shown in FIG. 5*a* taken along view lines C-C of FIG. 5*b*; the female member has been rotated to face the plug portion of the female member towards the top of the page.
Figure 5D:
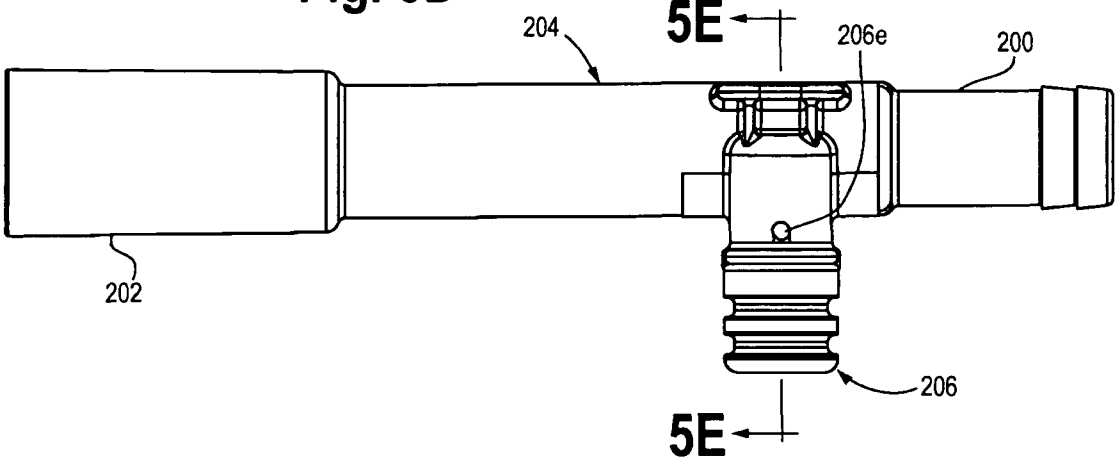
FIG. 5*d* is a rear sided plan view of the female member shown in FIG. 5*a;*
Figure 5F:
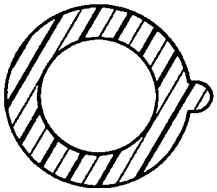
FIG. 5*f* is a sectional view taken along view lines F-F of the female member shown in FIG. 5*c;*
Figure 5E:
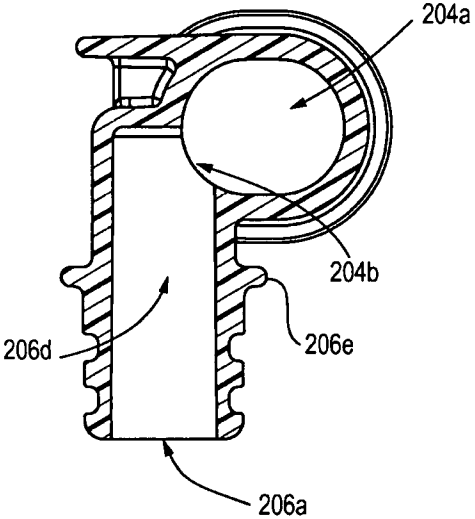
FIG. 5*e* is a sectional view taken along view lines E-E of the female member shown in FIG. 5*d;*

The male and female fittings, when assembled, form a fluid intake fitting or manifold. The fluid intake fitting can operate as a fluid intake manifold alone or by plugging or capping one of either, fluid intake couplings 100 or 200. FIG. 3*a*, 3*b* shows fluid coupling 100 capped with removable cap 110. As an alternative embodiment either one of male intake 100 or female intake 200 could have a sealed end opposite its male 102 or female 202 coupling. In this case it would be preferable to center the plugs along sections 104 and 204. To reorient the manifold with a sealed end to draw air from either the left or right side of the compressor housing one would simply reverse the coupling between the housing, and the first and second plugs 106, 206.

As can be seen with reference to FIG. 3*a*, 3*b*, the male fitting member is slidably engaged within the female fitting. The slidable engagement occurs along the interface of the female coupling and male coupling. The slidable engagement allows for the longitudinal length of the fluid intake fitting to be adjusted as required to assemble the fluid intake fitting to the fluid inlets on a dual piston pump or compressor.

The fluid intake fitting, when assembled to the air compressor, forms the fluid intake manifold which includes o-rings 107, 107', 207, 207' and can include cap 110. The air intake manifold is pressure sealed to the housing air intakes 44, 45 by o-rings 107, 207.

Although the manifold has been described as having a particular slidable engagement, the adjustment could include any type of longitudinally adjustable mating such as threads.

Figure 7:
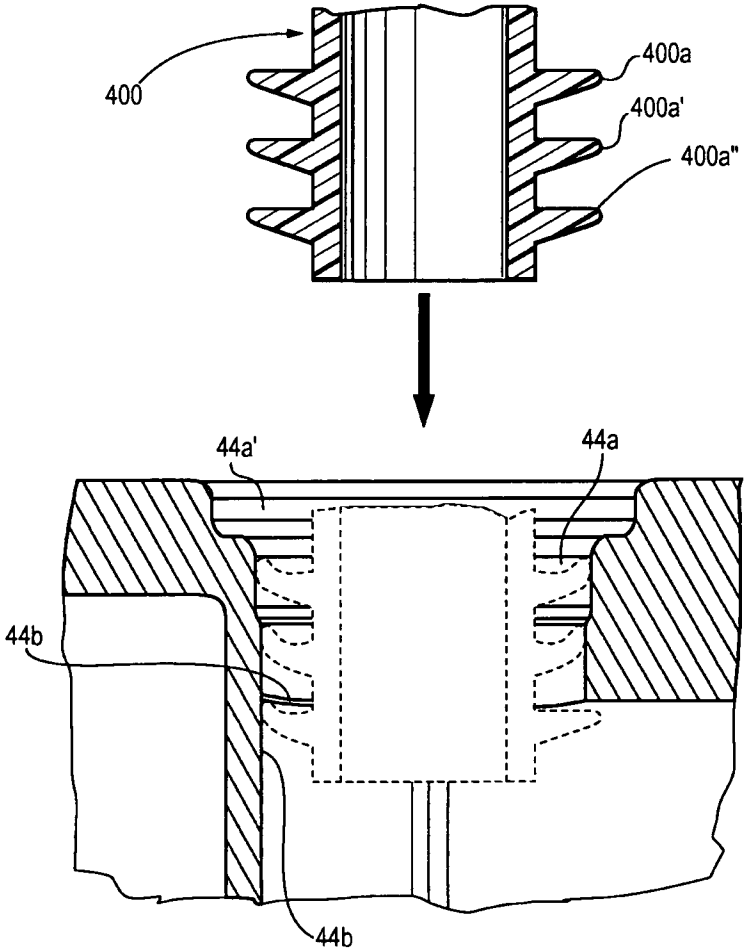
FIG. 7 is a sectional view of an alternative embodiment of a plug portion of the air intake manifold shown in FIG. 3*b*; the plug portion being shown inserted into the housing inlet.

An alternative embodiment of plug portions 106, 206 can be seen with reference to FIG. 7. The alternative plug 400 does not require o-rings. The plug, rather, has radialy extending flanges 400*a*, 400*a*' and 400*a*" forming an integral portion of the plug. The flanges both seal and secure the plug to the compressor inlet. Now referring to FIG. 7, the two flanges furthest from the plug opening 400*a*, 400*a*' provide a contact pressure seal with the housing portion defining intake 44. Particularly flange 400*a* seals against housing portion 44*a*' and flange 400*a*' seals against housing portion 44*a*. Flange 400*a*" does not function to serve as a contact seal with a housing portion defining intake 44. It rather serves the same function as o-ring 207'. Flange 400*a*" serves to prevent plug potion 400 from slipping out of air intake 44 during normal use. Range 400*a*, when plug 400 is fully inserted, extends over ledge portion 44*b*. the ledge 44*b* acts as a backstop over which flange 400*a*", which acts as an abutment, must be pulled to remove plug portion 400 from air intake 44. For convenience the interface of plug portion 400 with a pump air intake has been described with regard to pump intake 44 of pump 50. It is understood that the construction of the housing portion defining intake 44 is the same as the construction of the housing portion defining intake 45. The interface of plug portion 400 with housing intake 45 is the same as plug portion 400's interface with intake 44. Further, although plug portion 400 has been described as an alternative to portions 106, 206, it could be configured into a port fitting having a standard elbow or T shape like 32*a*, 32*b*, or 500.

Figure 9:
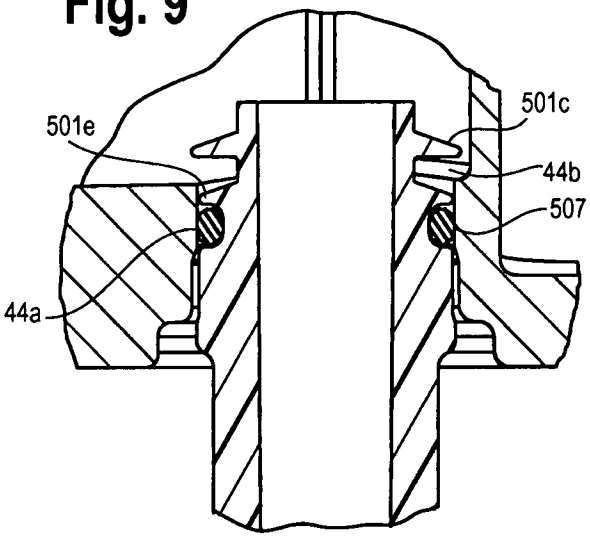
FIG. 9 is a sectional view of the port fitting in FIG. 8 as inserted into a pump or compressor housing inlet.
Figure 10:
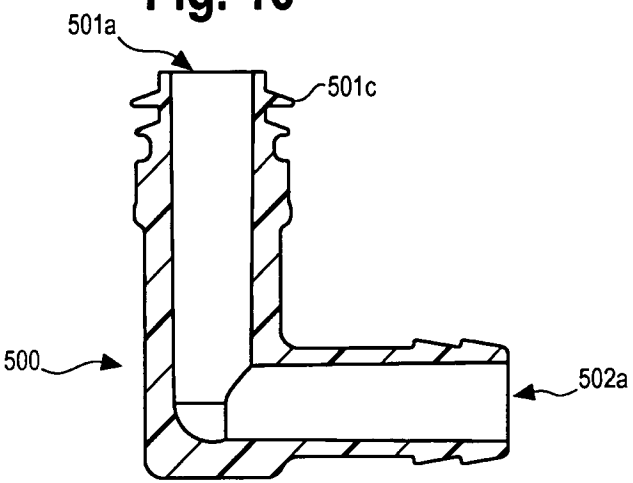
FIG. 10 is a sectional view of FIG. 8.
Figure 8:
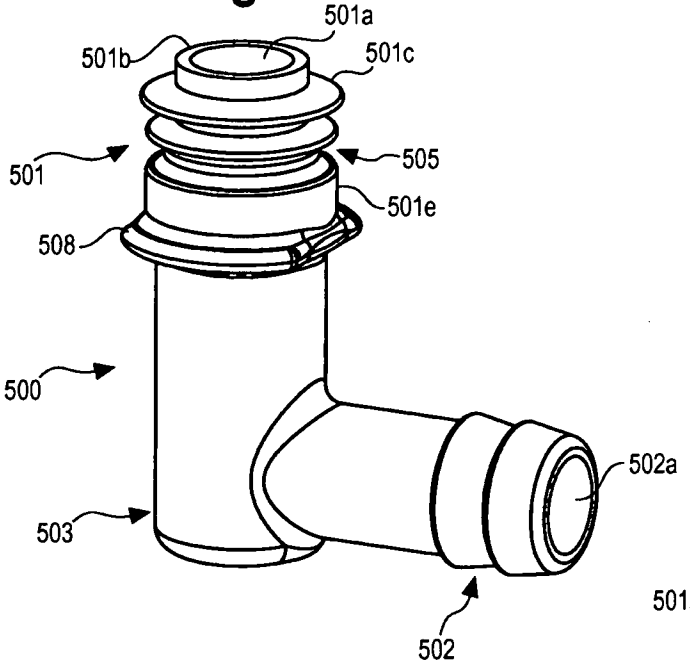
FIG. 8 is an alternative embodiment of a port fitting.

FIGS. 8-10 shows an alternative embodiment of a port fitting. Port fitting 500 is generally known as an elbow type fitting. Port fitting 500 could, however, be configured into a variety of shapes such as a T fitting. Port fitting 500 has plug portion 501 and coupling portion 502. Plug portion 501 and coupling portion 502 are joined by channel portion 503. The coupling portion has an external opening 502*a* opening through external end 502*b*. Coupling portion 502 defines a hollow which forms a fluid passage from external opening 502*a* into channel portion 503. Plug portion 501 has an external opening 501*a* which opens through external end 501*b*.

Plug portion 501 has a first radial flange 501*c*. Plug 501 has a raised insert surface 501*e*. An o-ring receiving groove 505 is formed in surface 501*e*. Groove 505 receives o-ring 507. A stop 508 is at the area where plug portion 501 joins channel portion 503. The stop 508 helps ensure fitting 500 is properly oriented relative to a pump air intake, such as 44, 45 or a pump outlet (not shown). The stop 508 acts as an abutment to prevent over insertion of the fitting 500. As seen in FIG. 10, port fitting 500 defines a fluid channel extending between opening 502*a* and opening 501*a*.

As can best be seen in FIG. 9 flange 501*c* serves the same function as flange 400*a*". It inhibits the removal of fitting 500 from air intake 44 during normal use. It acts as an abutment against ledge or backstop 44*b*. O-ring 507 seals against housing surface 44*a* to form a contact pressure seal in the same manner as o-ring 207. Fitting 500 will interface with intake 45 in the same manner as described with intake 44. Fitting 500 could also equally serve as a port fitting for a pump air outlet as opposed to an air inlet. Although 500 has been shown and described as a port fitting it could also be configured into a plug portion of male member 101 and female member 201.

Finally, although the fluid manifold 101, 201 has been described in connection with its interface with pump intakes 44, 45 it could also be used in connection with pump outlets. In this case, one would want to modify the plug portions 106, 206 so they have a construction similar to plug portions 501 or another construction suitable for a fitting on the pressure side of a pump.

Although the invention has been described in connection with a compressor it is equally applicable to a vacuum pump. Further, although there have been described embodiments of this invention, many variations and modifications will be apparent. The invention is therefore to be limited, not by the specific disclosure herein, which is exemplary, but by only the appended claims.

We claim:

1. A gas or air manifold of a compressor or vacuum pump wherein said manifold comprises:

a first member, wherein a portion of said first member forms a first coupling, a portion of said first member forms a first longitudinal section, and a portion of said first member forms a first fluid port;

said first coupling has an opening which opens through an external surface of said first coupling, said first longitudinal section has a fluid passage formed therein, said first coupling opening at said fluid passage of said longitudinal section;

said portion forming said first fluid port forming an internal orifice, said portion forming said first fluid port having an external opening which opens at said internal orifice, said first longitudinal section having an opening which opens into said orifice, said passage formed by said longitudinal section in fluid communication with said orifice through said first longitudinal section opening which opens at said orifice;

said portion forming said first coupling and said portion forming said first fluid port being integral with said first longitudinal section;

a second member, wherein a portion of said second member forms a second coupling, a portion of said second member forms a second longitudinal section, and a portion of said second member forms a second fluid port;

said second coupling has an opening which opens through an external surface of said second coupling, said second longitudinal section has a fluid passage formed therein, said second coupling opening at said fluid passage of said second longitudinal section;

said portion forming said second fluid port forming an internal orifice, said portion forming said second fluid port having an external opening which opens at said internal orifice of said second port, said second longitudinal section having an opening which opens into said second port orifice, said passage formed by said second longitudinal section in fluid communication with said orifice through said second longitudinal section opening which opens at said second port orifice;

said portion forming said second coupling and said portion forming said second fluid port being integral with said second longitudinal section;

a first fluid coupling, said first fluid coupling has an opening which opens through an external end of said first fluid coupling, said first fluid coupling forming a portion of said first member or a portion of said second member; and wherein said first member and said second member are adjustably engageable with each other, said adjustable engagement being along a longitudinal axis of said fluid intake manifold and wherein said first member is a single unitary integral piece and said second member is a single unitary integral piece.

2. The manifold of claim 1 wherein said first coupling is a female coupling and said second coupling is a male coupling, said first and second members adjustably engageable at said female and male coupling.

3. The manifold of claim 1 wherein said first and second longitudinal sections, and said first and second couplings, all have oval cross sections.

4. A gas or air manifold of a compressor or vacuum pump wherein said manifold comprises:

a first member, wherein a portion of said first member forms a first coupling, a portion of said first member forms a first longitudinal section, and a portion of said first member forms a first fluid port wherein said first member is a single unitary integral piece;

said first coupling has an opening which opens through an external surface of said first coupling, said first longitudinal section has a fluid passage formed therein, said first coupling opening at said fluid passage of said longitudinal section;

said portion forming said first fluid port forming an internal orifice, said portion forming said first fluid port having an external opening which opens at said internal orifice, said first longitudinal section having an opening which opens into said orifice, said passage formed by said longitudinal section in fluid communication with said orifice through said first longitudinal section opening which opens at said orifice;

said portion forming said first coupling and said portion forming said first fluid port being integral with said first longitudinal section;

a second member, wherein a portion of said second member forms a second coupling, a portion of said second member forms a second longitudinal section, and a portion of said second member forms a second fluid port;

said second coupling has an opening which opens through an external surface of said second coupling, said second longitudinal section has a fluid passage formed therein, said second coupling opening at said fluid passage of said second longitudinal section;

said portion forming said second fluid port forming an internal orifice, said portion forming said second fluid port having an external opening which opens at said internal orifice of said second port, said second longitudinal section having an opening which opens into said second port orifice, said passage formed by said second longitudinal section in fluid communication with said orifice through said second longitudinal section opening which opens at said second port orifice;

said portion forming said second coupling and said portion forming said second fluid port being integral with said second longitudinal section;

a first fluid coupling, said first fluid coupling has an opening which opens through an external end of said first fluid coupling, said first fluid coupling forming a portion of said first member or portion of said second member; and wherein said first member and said second member are adjustably engageable with each other, said adjustable engagement being along a longitudinal axis of said fluid intake manifold; and wherein said first member is a single unitary integral piece and said second member is a single unitary integral piece; and wherein said first coupling overlaps with said second coupling.

* * * * *